United States Patent [19]

Dickey et al.

[11] 4,327,500

[45] May 4, 1982

[54] COMPUTATIONAL AID DEVICE FOR EKELUND RANGING

[75] Inventors: David C. Dickey, Ashton; Barry R. Korb; James H. Baroff, both of Bethesda; Samuel J. Raff, Chevy Chase, all of Md.

[73] Assignee: The United States of America as represented by the Secretary of the Navy, Washington, D.C.

[21] Appl. No.: 717,490

[22] Filed: Mar. 27, 1968

[51] Int. Cl.[3] ..... B43L 7/00; B43L 13/00

[52] U.S. Cl. ..... 33/457; 33/464; 33/472; 235/61 D; 235/61 GM; 235/69; 367/99

[58] Field of Search ..... 235/124, 127, 106, 135, 235/69, 61 D, 61 GM; 33/149, 150, 151, 152, 156, 153, 155, 97, 102, 103, 94, 464, 457, 472; 367/99

[56] References Cited

U.S. PATENT DOCUMENTS

| | | | |
|---|---|---|---|
| 1,409,342 | 5/1922 | Henrichs | 33/97 |
| 3,104,469 | 9/1963 | Burns et al. | 33/97 |

*Primary Examiner*—S. C. Buczinski

*Attorney, Agent, or Firm*—R. F. Beers; R. W. Adams; H. A. David

[57] ABSTRACT

A computational aid device for Ekelund range determinations comprising a base member adapted to be placed over a bearing/time plot and including two leg members to be aligned with intersecting bearing rate lines faired through the plot, and a range scale positionable with respect to the base and the leg members to provide direct readings of range and of probable limits of range error.

2 Claims, 6 Drawing Figures

COMPUTATIONAL AID DEVICE FOR EKELUND RANGING

BACKGROUND OF THE INVENTION

This invention relates to a computational aid for the determination of range, for example of a target ship from a submarine, by a passive sonar technique of observing bearing changes of the target ship as the ranging vessel performs a predetermined maneuver in which its own courses and speeds are known. One such technique is known as Ekelund ranging and involves the recording, usually graphically against time, of the bearings of the target at timed intervals while the ranging or "own" ship is making good a first course and speed having a component crossing the line of sight between the ships, and then changing course of the own ship and again recording the target ship bearings. The slopes of lines faired through the time/bearing plot are indicative of average rate of change of bearing. The angles made by these lines with respect to the time axis of the plot may be utilized, together with the known own ship's speeds across the line of sight, to trigonometrically calculate the range of the target ship.

Heretofore this has been done by actually measuring the slope of each bearing rate line with a bearing rage template, computing algebraically a numerical value of change in bearing rate ($\Delta\dot{B}$), obtaining a numerical value for change in own ship speed across the line of sight ($\Delta V$), and setting these numerical values into a circular slide rule to obtain the Ekelund range ($R_E$) in accordance with the formula:

$$R_E = K\,(\Delta V/\Delta\dot{B}),$$

where K is a scaling factor.

An analysis of detailed data and calculations on a substantial number of Ekelund range determination in a controlled exercise has indicated the following facts.

Approximately 15% of the rangings analyzed had some type of mistake in the slide rule computation of range which caused an error greater than should be expected considering the degree of accuracy which can be obtained from the slide rule in use.

25% (7 of 28) of the rangings examined had bearing rate estimates on at least one leg which differed significantly (greater than 25%) from the computed values of least square fit lines drawn through the bearings. Three of these seven cases were due to mistakes in determining the slopes from the bearing rate template currently used in passive ranging and these produced errors in the final ranges of 34.5%, 48.9%, and 205.5%. The remaining four cases appeared to be due to improper fairing of the line through the bearings and caused errors in the computed ranges between 21% and 38%.

In many range calculations, errors of more than one type were present. A total of 32% of the 28 rangings examined had some type of numerical mistake in either the interpretation of the bearing rate, multiplication of a velocity by a trigonometric function or in the slide rule calculation of range.

The exercise results discussed above indicate a need for improvement in two particular areas. These are reduction in human error incurred in range solutions and improvement in ranging maneuvers. The situation with regard to the second area is complex, because obtaining an accurate range determination is not the only concern of the attacking submarine. He must close his target and at the same time maintain a reasonably low probability of counter-detection. During this process he must perform ranging maneuvers to the extent which the tactical situation permits and the most pressing requirement is perhaps for some way of determining just how good the ranging maneuvers which he has performed are, in terms of probable ranging accuracy.

SUMMARY OF THE INVENTION

With the foregoing in mind, it is a primary object of the present invention to provide a computational device for mechanizing the Ekelund range calculation so as to minimize the probability of computational mistakes.

Another important object of this invention is the provision of an Ekelund ranging computational device which is capable of indicating the probable error involved in a particular range determination, assuming that no computational mistakes are made.

As another object this invention aims to accomplish the foregoing through the provision of a computational device comprising a base member adapted to be placed over a bearing/time plot and including two leg members to be aligned with intersecting bearing rate lines faired through the plot, and a range scale positionable with respect to the base and the leg members to provide direct readings of range and of probable limits of range error.

BRIEF DESCRIPTION OF THE DRAWINGS

The invention may be further said to reside in certain constructions and arrangements of parts whereby the foregoing objects and advantages may be achieved as well as others which will become apparent from the following detailed description when read in conjunction with the accompanying sheets of drawing forming a part of the specification, and wherein.

DESCRIPTION OF THE PREFERRED EMBODIMENT

Figure 1:
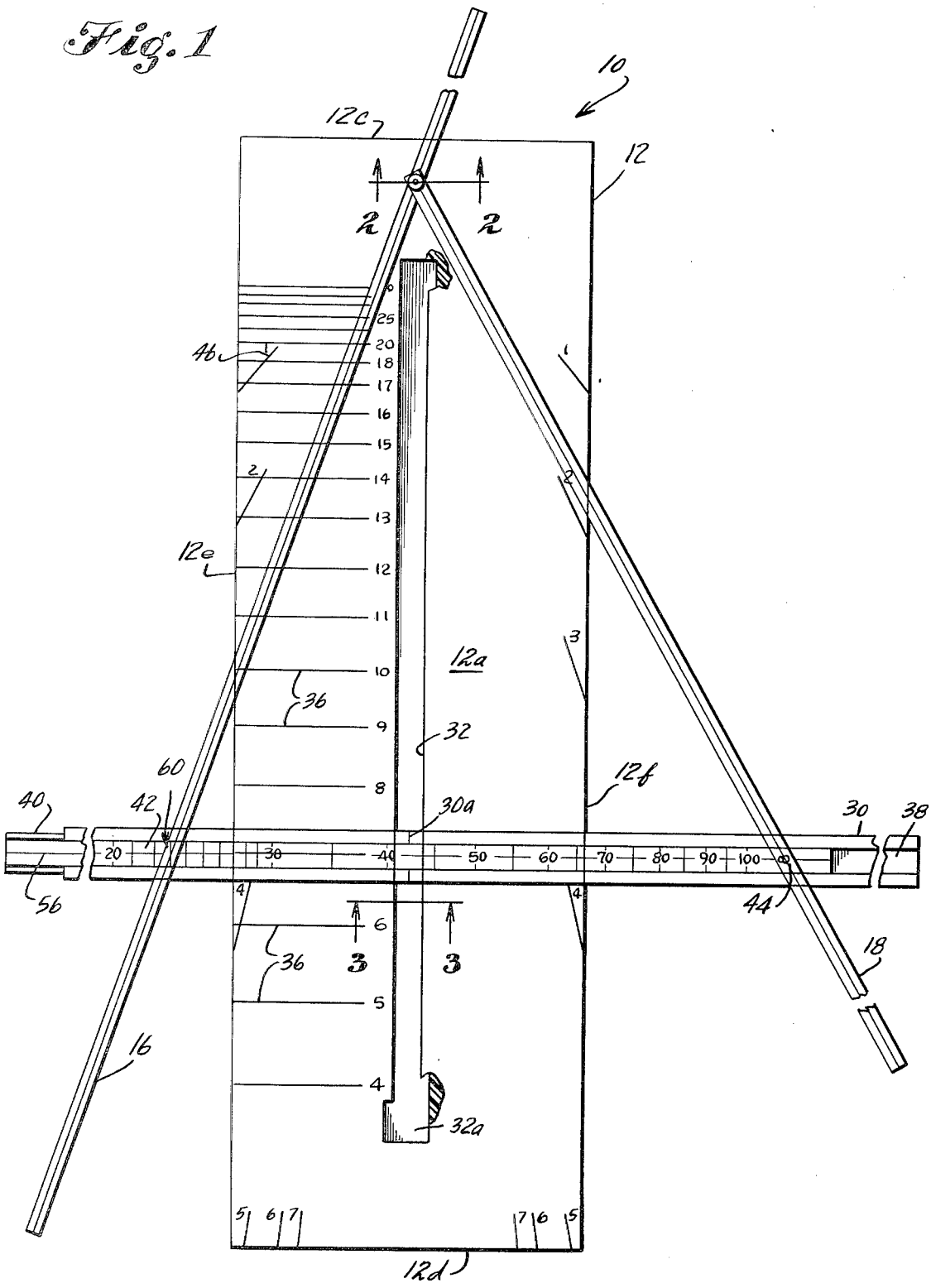
FIG. 1 is a top elevational view of a computational aid device embodying the present invention.

In the form of the invention illustrated in the drawings and described hereinafter, there is provided a computational aid device, generally indicated at 10, which is particularly useful in making Ekelund range determinations. The device 10 comprises a rectangular base member 12 which is preferably formed of a transparent plastic material such as "Lucite", "Plexiglas" or the like to permit viewing therethrough of underlying lines when the device 10 is placed on a graphic plot as will be described more fully hereinafter. The base member 12, which has parallel upper and lower surfaces **12*a* and 12*b*, relatively short end edges 12*c* and 12*d*, and relatively long side edges 12*e* and 12*f***, is of sufficient thickness to provide rigidity and support for other members about to be described.

Figure 2:
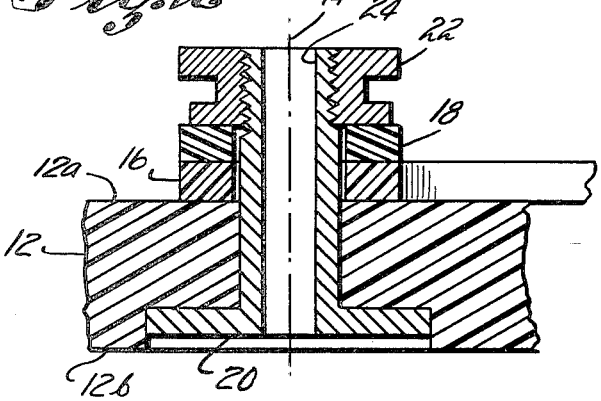
FIG. 2 is a fragmentary sectional view, on an enlarged scale, of a portion of the device of FIG. 1 taken substantially along line 2—2 thereof.

Mounted on the base 12 for pivotal movement about a common axis 14 are first and second elongated members 16 and 18, also conveniently formed of a transparent plastic material. The pivotal mounting of the leg members 16 and 18 is effected by a hollow screw 20 which is best illustrated in FIG. 2, and a cooperating locking or clamping nut 22. The latter is conveniently knurled for manual operation to release the leg members 16 and 18 for adjustment about their common axis 14, and for securing the leg members in adjusted positions with respect to the base member. The central bore 24 serves as a reference aperture through which the intersection of lines on an underlying plot may be viewed.

The pivot screw 20, and hence the axis 14, is located on the longitudinal centerline of the base member 12 near one end edge 12*c* thereof.

Figure 3:
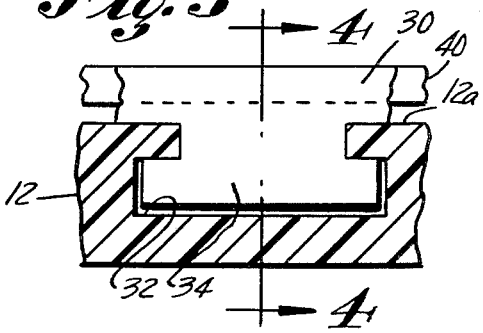
FIG. 3 is a fragmentary sectional view, on an enlarged scale, of a portion of the device of FIG. 1 taken substantially along lines 3—3 thereof.
Figure 4:
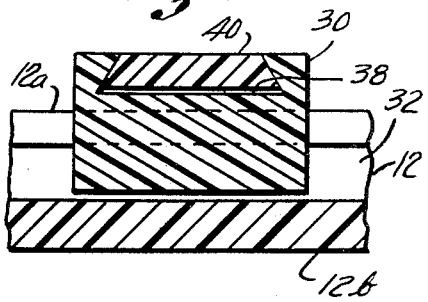
FIG. 4 is a sectional view taken substantially along line 4—4 of FIG. 3.

Mounted on the base member 12 is a bar 30 which extends transversely of the length of the base member and is adapted to be slideably moved through parallel positions toward or away from the axis 14. To this end and as is best illustrated in FIGS. 3 and 4, the base member 12 is provided with an inverted T-slot 32 which runs parallel to the side edges 12*e* and 12*f*. The bar 30 has formed, at the center of the lower side thereof, beneath a center index mark 30*a*, an inverted T member 34 which is slideably received in the slot 32 and cooperates with the sidewalls thereof to permit sliding movement of the bar toward and from the axis 14 while maintaining the long axis of the bar at right angles to the side edges 12*e* and 12*f*.

The opening of the slot 32 is conveniently enlarged at one end as illustrated at 32*a* in FIG. 1 to permit assembly and disassembly of the bar 30 with the base member 12. The upper surface 12*a* of the base member 12 is provided with a scale including indicia 36 representing change in own ship speed across the line of sight ($\Delta V$).

The bar 30 is provided with a longitudinal channel 38 in its upper surface in which is slideably retained an elongated range scale 40.

The range scale 40 is slideably retained in the channel 38 by an convenient means, for example by providing a dove-tail engagement as illustrated in FIG. 4. The range scale 40 is provided with graduated indicia 42 and an index mark 44, the uses of which will later be made apparent.

Along the side edges 12*e* and 12*f* and the end edge 12*d* are two scales including indicia 46 representing time in minutes during which the bearing data was accumulated for an Ekelund range determination. The indicia 46 extend radially with respect to the axis 14 and are utilized to position the leg members 16 and 18 to determine the scope of probable error involved in a given Ekelund range determination.

Figure 5:
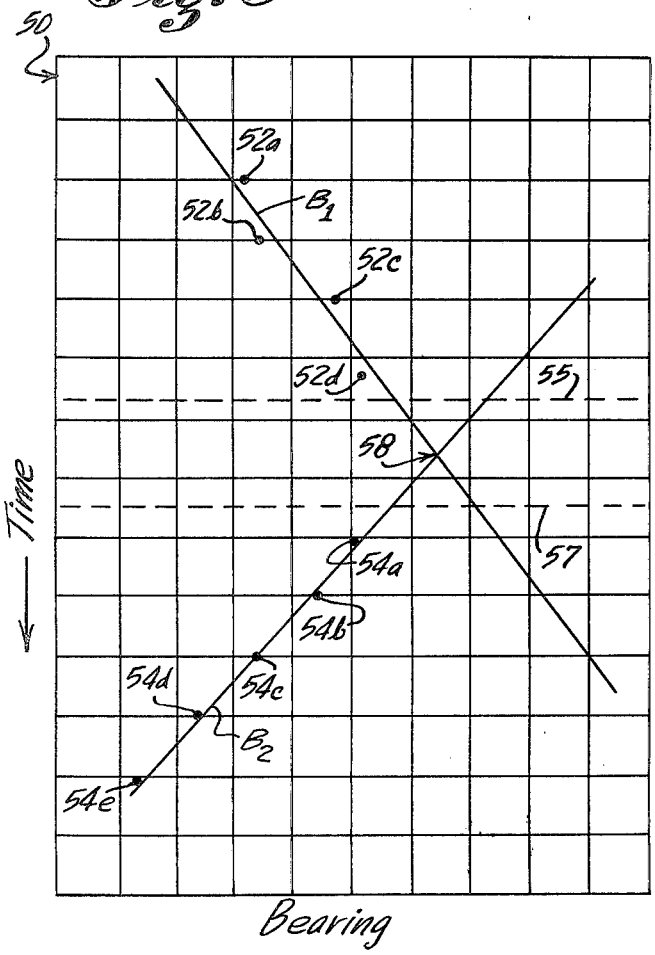
FIG. 5 is a plan view of a graphic plot of target ship bearings versus time.

Referring now to FIG. 5, there is illustrated therein a graphic plot 50 of bearing taken of a target ship, plotted against time. The bearings obtained as time progressed while the ranging or "own" ship proceeded at one course and speed are indicated by points such as 52*a*–52*d*. The bearings obtained as time progressed after a change of course and/or speed by own ship are indicated at 54*a*–54*e*. The interval during which the own ship course and/or speed was changed lies between the dashed lines 55, 57, during which time no bearings were recorded.

As will be understood by those familiar with Ekelund range determination, the maneuver relies on a change in speed of own ship across the line of sight between the ships, hereinafter referred to as $\Delta V$. A numerical value of $\Delta V$ is obtained, for example, by simple trigonometric or graphic determination of components of the ships actual speeds which are normal to the line of sight for each of the two "legs" of the maneuver, and algebraically combining these components. This value is set into the device 10 by moving the bar 30 along the channel 32 until the longitudinal centerline 56 of the range scale 40 is aligned with the indicia 36 corresponding to the value of $\Delta V$. Of course settings between indicia 36 may be estimated in positioning the bar 30.

When the bearing/time plot has been obtained, lines $B_1$ and $B_2$ are faired through the points 52*a*–52*d* and 54*a*–54*e*, respectively, and extended through an intersection 58 with one another. These lines each represent, by their slopes, the average bearing rates $\dot{B}_1$ and $\dot{B}_2$ for the two legs of the Ekelund maneuver.

Now, the device 10 may be placed on the plot 50 with the sides 12*e* and 12*f* parallel to the time axis, and the intersection 58 aligned with the axis 14 as may be determined by viewing through the reference hole or bore 24. Then, the leg members 16 and 18 are positioned with a line ruled along the center of each leg member. Thus, in the example being described, the leg member 16 will be aligned with bearing rate line $B_1$ and leg member 18 will be aligned with bearing rate line $B_2$. The angle between the leg members 16 and 18 is representative of the change in average bearing rate ($\Delta B$).

Next, the range slide 40 is moved along its long axis until the range index 44 coincides with the centerline of leg member 18 and the Ekelund range $R_E$ may be read directly from the scale on the range slide where it is intersected by the centerline of the leg member 16 as indicated generally at 60 in FIG. 1. Thus, the scale 40 shows the numerals "23" at that location, which with a scale factor of 100 would be indicative of a range of 2300 yards.

Having made the Ekelund range determination, it is of interest to a submarine commander in evaluating his tactical position to have an idea of the accuracy of the range obtained. Obviously, the longer a period over which bearings are plotted, the more accurate the ultimate range determination will be, other considerations being equal. The present invention therefore makes provision for providing a rapid determination of the probable limits of error in the range determination.

Figure 6:
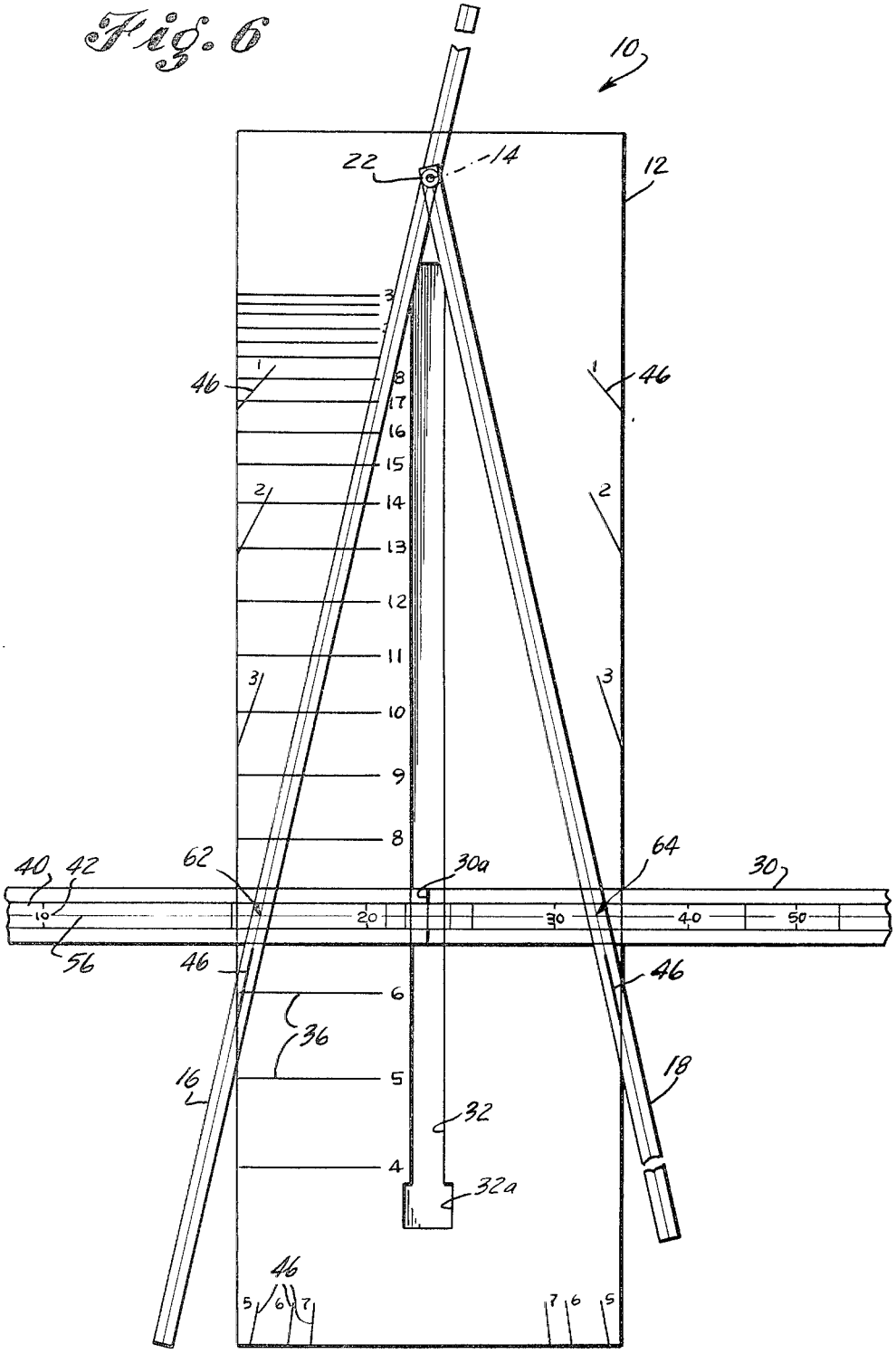
FIG. 6 is a view similar to FIG. 1 but with parts illustrated in different positions.

To accomplish this it is only necessary to set the leg members 16 and 18, as shown in FIG. 6, at the time (minutes) indicia 46 on the respective edges of the base member 12, corresponding to the time in minutes that the shorter "leg" of the Ekelund maneuver took to complete. In the present example the shorter leg run constituted four minutes of plots so the leg members 16 and 18 are placed at the four minute indicia in FIG. 6, without disturbing the $\Delta V$ setting of the bar 30.

Then, the range $R_E$ which, according to FIG. 1, was determined to be 2300 yards is set into the device 10 by moving the range scale 40 to bring the numeral "23" thereon into registration with the center index of the bar 40. Thereupon, the lowest and upper probable limits of the actual range may be read from the intersection of the range scale with the leg members 16 and 18, respectively. Thus, the lower probable limit of range may be read at 62 as 1600 yards, and the upper probable limit may be read at 64 as 3200 yards.

Obviously many modifications and variations of the present invention are possible in the light of the above teachings. It is therefore to be understood that within the scope of the appended claims the invention may be practiced otherwise than as specifically described.

What is claimed is:

1. A computational device of the character described, comprising:

a rectangular base member (12) of transparent material having plane upper and lower surfaces (12*a*, 12*b*), said base member having wall surfaces defining an elongated groove (32) of inverted T-shaped cross section in said upper surface, said groove extending parallel to the longer sides (12*e*, 12*f*) of said base member and centrally disposed therebetween;

a transverse bar (30) having an inverted T-shaped member extending from the central portion of said bar into said groove and cooperating with the surfaces of said body member defining said groove to maintain the long axis of said bar normal to said longer side edges of said base member and extending outwardly thereof while permitting sliding translation of said bar through parallel positions thereof;

said bar having surfaces defining an elongated channel (38) along the length thereof;

a range scale member (40) mounted in said channel for sliding movement longitudinally of said bar;

a first elongated leg member (16);

a second elongated leg member (18);

pivot means pivotally securing said first and second leg members to said base member adjacent one end of said base member for independent pivotable movement about an axis (14) which is normal to said upper surface of said base member, said first and second leg members each being connected only to said base member and being movable to variably intersect said transverse bar and said range scale member, one of said leg members terminating at said pivot means, and the other of said leg members extending beyond said pivot means.

2. A computational device as defined in claim 1 and wherein:

said pivot means comprises a screw (20) extending through said base member and said leg members, said screw having a central axial bore (24), and a nut member (22) threadedly engaged on said screw in releasable clamping relation to said leg members.

* * * * *